United States Patent [19]

Grow

[11] Patent Number: 4,565,342

[45] Date of Patent: Jan. 21, 1986

[54] ANCHORING DEVICE FOR ROCK CLIMBING

[76] Inventor: Robert D. Grow, 2708 Green Bay Way, Sacramento, Calif. 95826

[21] Appl. No.: 630,369

[22] Filed: Jul. 12, 1984

[51] Int. Cl.[4] ..... A47G 29/00

[52] U.S. Cl. ..... 248/1

[58] Field of Search ..... 248/1, 544

[56] References Cited

U.S. PATENT DOCUMENTS

| | | | |
|---|---|---|---|
| 2,979,297 | 4/1961 | Suozzo | 248/544 X |
| 3,877,679 | 4/1975 | Lowe | 248/1 |
| 4,184,657 | 1/1980 | Jardine | 248/1 |

*Primary Examiner*—Ramon S. Britts
*Assistant Examiner*—Ramon O. Ramirez

[57] ABSTRACT

An anchoring device for rock climbing, mountain climbing and the like employing convex cams pivotally mounted on a spindle that extends between like ends of two longitudinal frame members, the cams being spring-loaded and attached by wires to a slidable operating bar, with a connection between the longitudinal frame members at the end opposite the cams, said connection completing the frame and serving as an attachment point for a rope. The operating bar is notched at the center and mounted in slots in the longitudinal frame members. The contact surfaces of the cams have an arcuate cross section.

4 Claims, 3 Drawing Figures

ANCHORING DEVICE FOR ROCK CLIMBING

Figure 1:
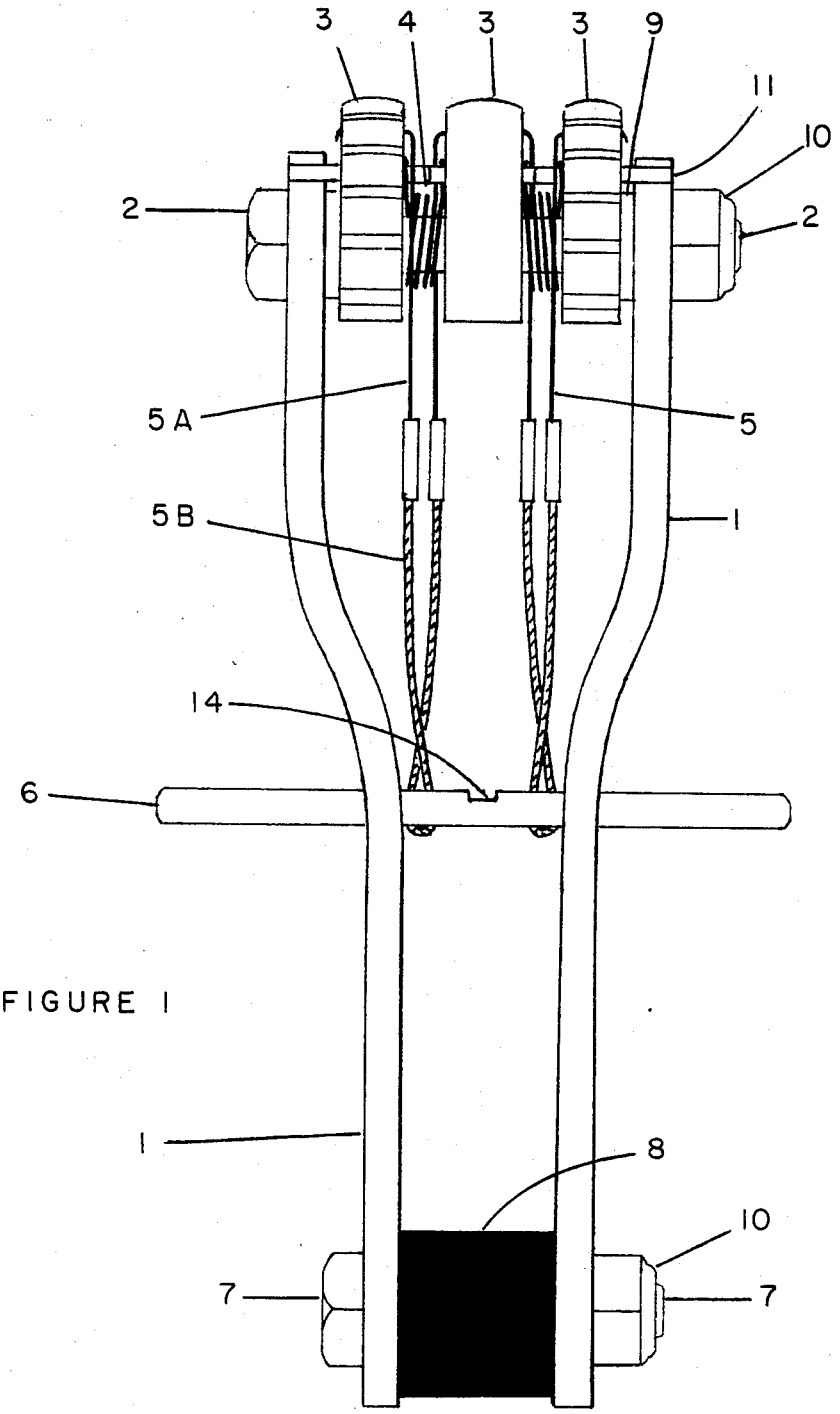

The invention is in the field of anchoring devices for rock climbing, mountain climbing, and the like.

DISCUSSION OF PRIOR ART

When climbing cliffs, rock climbers work in teams, securing themselves against dangerous falls with ropes they anchor to the cliff face. The ropes are anchored by various means. One such means employs pitons, which are steel spikes or wedges that are driven with hammers into natural cracks in the rock. Another means employs artificial chockstones, or "nuts", which are specially shaped chunks of aluminum that climbers place in cracks where the crack narrows below the placement. A nut resists being pulled downward, because it jams in the narrowing of the crack. Another means employs spring-loaded anchoring devices known by the trade name "Friend", patented by Jardine (U.S. Pat. No. 4,184,657). The Friend device lodges solidly in cracks by mechanical action of opposing cams. The present invention introduces an improved anchoring device employing the principle of opposing cams.

OBJECTS

An object of the invention is to provide an anchoring device similar in operation and function to the Friend, but which is easier to remove from confined placements without the aid of a specialized tool.

A problem in removing the Friend is that removal requires an operating bar to be pulled at two points simultaneously and evenly, the two points being on opposite sides of the Friend's central support bar. One or both of the two points may be different or impossible to reach with the fingers when a Friend must be removed from a confined placement, such as a placement in a narrow crack. Specialized extractor tools for this situation have been designed and marketed.

The anchoring device of the present invention has an operating bar, like a Friend has, but this operating bar need not be pulled at two points simultaneously and evenly to remove the device from its placement. Instead of being built around a central support bar, like a Friend, the parts of the invention are built around a frame structure, with the two longitudinal members of the frame spaced apart, leaving the midpoint of the operating bar exposed. Pulling the operating bar at its midpoint allows removal of the anchoring device from its placement.

Having to pull at only one point on the operating bar rather than two is particularly advantageous for climbers equipped with a simple hooked tool such as many carry for removing nuts. Such a tool can be used to pull on an operating bar at one point, but not at two points simultaneously. Among the other objects of the invention is the realization of each of the following advantages of its design (as compared to that of the Friend):

a. Stop means can be placed on the longitudinal frame members to limit the rotation of the outer cams. Lacking such stop means or any adjacent fixed member on which to place them, the outer cams of a Friend can rotate into an overextended position that makes the Friend difficult or impossible to remove from a crack. Such an overextension of the outer cams occurs when their longest radius, measured from the spindle, forms an angle of greater than 90 degrees with the support bar. The outer cams can rotate into this position if the inner cams are retracted. Situations in which the outer cams of a Friend become overextended sometimes occur as a result of the device being pivoted in its placement.

b. The cams can be placed closer to each other, because no support bar separates them. Having the cams close together is advantageous when a crack is either shallow or flaring. In either case, the probability of obtaining a placement in whcih all the cams contact the sides of the crack is improved if the cams are close together.

c. An effective anchoring device can be made with as few as three cams. The design of the Friend requires an even number of cams, and four is preferred. One advantage of having three cams instead of four is the same as that of having the cams close together—three cams can be placed closer together, in the sense of lesser distance across the cams, than four. Another advantage of having three cams instead of four is that an anchoring device having three cams will fit better in certain placements.

Further objects and advantages of the invention will become apparent from consideration of the drawings and the description thereof.

DRAWINGS AND OPERATION

One embodiment of the invention will now be described with reference to the accompanying drawings.

FIG. 1 is a front view of an anchoring device according to the invention.

Figure 2:
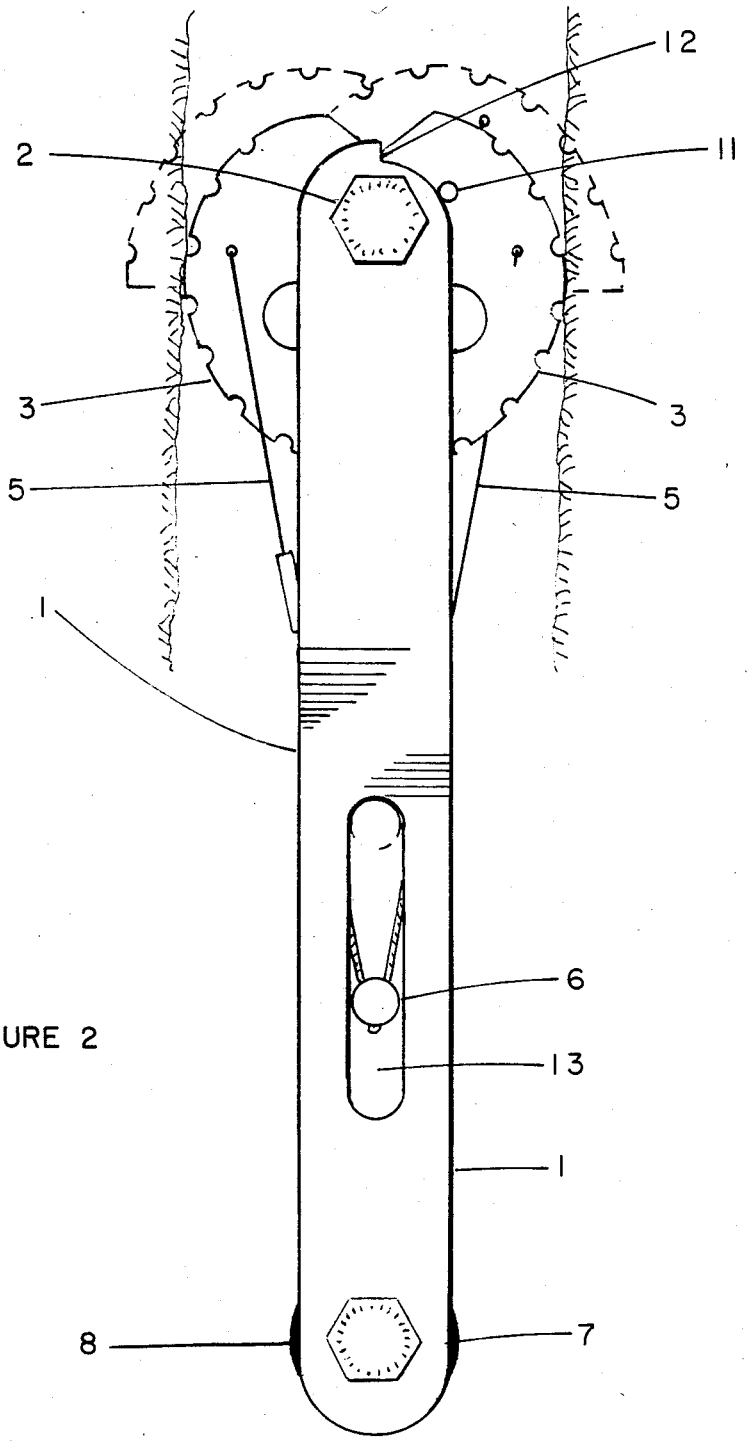

FIG. 2 is a side view of the anchoring device of FIG. 1 as it would appear placed in a crack and ready for use. Two positions of the cams are shown. The position shown in solid lines is that corresponding to proper placement in the crack, with the cams partially retracted. The position shown in dashed lines is the relaxed and fully extended position of the cams.

Figure 3:
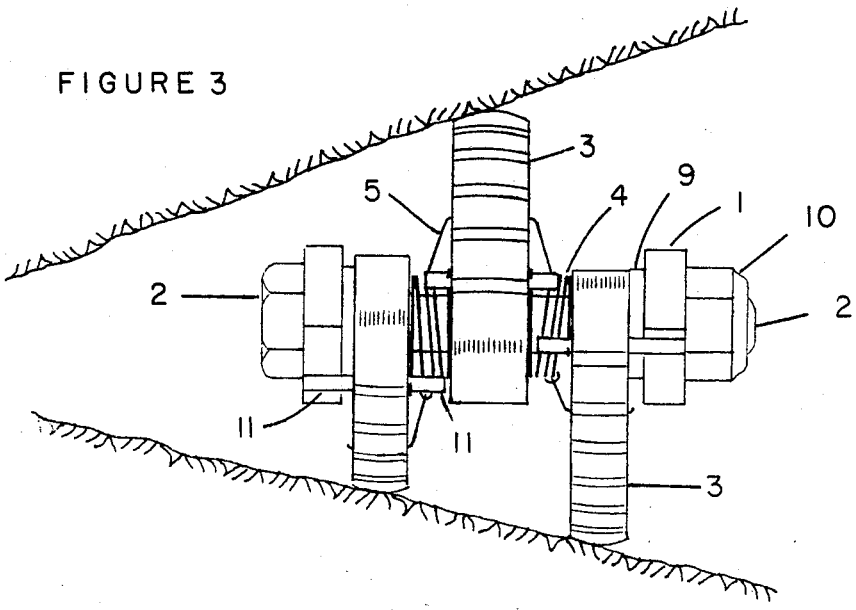

FIG. 3 is a top view of the anchoring device of FIGS. 1 and 2 as it would appear in a flaring crack.

In the drawings, the anchoring device is formed by the longitudinal frame members (1), the spindle bolt (2), the cams (3), coil springs (4), operating wires (5), an operating bar (6), and a connecting bolt (7). The contact surfaces of the cams (3) are rounded to an arcurate cross section, as shown in FIG. 1 and FIG. 3. By making the contact surfaces arcurate in cross section, the possibility of obtaining contact with the rock only at the edges of the contact surfaces is reduced, especially when the placement is in a flaring crack. The connecting bolt (7) is encased between the longitudinal frame members (1) by a rigid inner sleeve that keeps the longitudinal frame members separated and by an outer sleeve (8) of a material such as rubber that gives good purchase for the climber's thumb. The operating wires (5) preferably consist of a segments of solid wire (5A) that hook through the cams (3), swaged to segments of thin wire rope (5B) that pass through the opperating bar (6). The two outer cams (3) are spaced from the longitudinal frame members (1) by spacers (9) of low friction material. Both the spindle bolt (2) and the connecting bolt (7) are secured with lock nuts (10).

Spring pins (11) extend through each of the cams (3), forming fixed abutments on both sides of each cam. These abutments secure the hooked ends of the coil springs (4) and also serve as stop means to limit the rotation of the cams. These abutments alone, however, would be ineffective in limiting the rotation of the two outer cams when the inner cam is in a retracted or partially retracted position. Therefore, additional stop means are provided, consisting of indentations (12) in the longitudinal frame members (1). Said indentations (12) engage the spring pin abutments (11) on the outer surfaces of the outer cams, preventing rotation into an overextended position that would complicate removal of the anchoring device from its placement.

In use, the operating bar (6) is drawn with the fingers, against counterpressure of the thumb on the outer sleeve (8) of the connecting bolt (7), along the slots (13) in the longitudinal frame members (1), to pivot the cams (3) into a retracted position, against the urging of the coil springs (4). The anchoring device is then introduced into a crack of suitable width, and the operating bar (6) is released, whereupon the coil springs (4) urge the cams (3) as far back toward their fully extended position as the width of the crack will allow. With the cams (3) partially extended and in contact with the sides of the crack, the anchoring device will not be pulled out of the crack when a load is applied. Such a load will only increase the jamming force between the cams (3) and the sides of the crack, as friction forces the cams (3) toward a fully more extended position that they cannot attain, given the fixed width of the crack.

Removal of the anchoring device is accomplished by pulling on the operating bar (6) with the fingers, against counterpressure with the thumb, to retract the cams (3). With the cams retracted, the anchoring device can be easily withdrawn. When the crack is too narow to admit the fingers, the operating bar (6) may be pulled at its midpoint with a tool, such as a piece of stiff wire bent into a hook at the end. A notch (14) in the operating bar facilitates removal with a tool by helping to keep the tool centered on the operating bar, so the cams will be retracted simultaneously and evenly.

While the above description contains many specificities, these should not be construed as limitations on the scope of the invention, but rather as an exemplification of one preferred embodiment thereof. Many other variations are possible. For example, the connection between the two longitudinal frame members (1), that is formed by the connecting bolt (7), its rigid inner sleeve and its outer sleeve (8) could be replaced by a single piece in which this connection is integral to and a continuation of both frame members, as it would be if both lingitudinal frame members were formed by a single piece with a U-shaped bend at the end furthest from the cams. As another example, the anchoring device could have four cams instead of three: the two cams on each side of the center line of the anchoring device would be spring loaded against each other, and the two middle cams would be separated by a spacer of low friction material. As another example, the cams could be separated by tubular spacers of low friction material, and the coil springs would wrap loosely around these spacers. The tubular spacers would assure that the cams remained a given distance apart and could not move closer together by compressing the coil springs. The invention includes designs in which the operating wires (5) are far enough apart to allow a finger to be inserted between them to help draw back the operating bar (6); and designs in which the operating wires are too close together to allow a finger to be inserted between them, in which case the operating bar (6) is drawn back with fingers outside the longitudinal frame members (1).

What I claim is:

1. An anchoring device for climbing having: two longitudinal frame members; two or more convex cams mounted on a spindle that extends between like ends of the longitudinal frame members, with each cam adapted for pivotal movement in the direction opposite the movement of an adjacent cam or cams; an operating bar slidably mounted in slots in the longitudinal frame members said operating bar having its center or midpoint exposed between the two longitudinal frame members to allow easy access to the center of the operating bar and facilitate operation of the device, said operating bar being connected to each cam such that sliding the operating bar in the slots in the direction away from the cams will actuate movement of the cams from an extended to a retracted position against the urging of coil springs mounted on the spindle and connected to the cams; and a connection between the longitudinal frame members at the end furthest from the cams, said connection serving as an attachment point for a climbing rope and completing the frame; said frame having two parallel sections of unequal widths, the section at the end nearest the cams being wider, as width is measured by the distance between the two longitudinal frame members.

2. An anchoring device as in claim 1 having its operating bar notched at the midpoint to provide a grasping point for a tool.

3. An anchoring device as in claim 1 having stop means on the longitudinal frame members, said stop means being so located as to engage cooperating stop means on the outer surfaces of the outer cams, preventing rotation of the cams into an overextended position.

4. An anchoring device as in claim 1 with the contact surfaces of the cams rounded to an arcurate cross section.

* * * * *

UNITED STATES PATENT AND TRADEMARK OFFICE

CERTIFICATE OF CORRECTION

PATENT NO. : 4,565,342

DATED : January 21, 1986

INVENTOR(S) : Robert D. Grow

It is certified that error appears in the above-identified patent and that said Letters Patent is hereby corrected as shown below:

Column 1, line 35, "different" should read --difficult--.

Column 2, line 43, "arcurate" should read --arcuate--.

Column 2, line 45, "arcurate" should read --arcuate--.

Column 3, line 45, "lingitudinal" should read --longitudinal--.

Column 4, line 49, "arcurate" should read --arcuate--.

Signed and Sealed this

*Sixth* Day of *May 1986*

[SEAL]

*Attest:*

DONALD J. QUIGG

*Attesting Officer*

*Commissioner of Patents and Trademarks*